United States Patent [19]

Ikeguchi et al.

[11] Patent Number: 4,994,753

[45] Date of Patent: Feb. 19, 1991

[54] SYNCHROTRON RADIATION SOURCE

[75] Inventors: Takashi Ikeguchi, Hitachi; Manabu Matsumoto, Ibaraki; Shinjiroo Ueda, Abiko; Tadasi Sonobe, Iwaki; Toru Murashita, Atsugi; Satoshi Ido, Isehara; Kazuo Kuroishi, Hitachi; Akinori Shibayama, Isehara, all of Japan

[73] Assignees: Hitachi, Ltd.; Nippon Telephone & Telegraph Corp., both of Tokyo; Hitachi Service Engineering Co., Ltd., Ibaraki, all of Japan

[21] Appl. No.: 169,598

[22] Filed: Mar. 17, 1988

[30] Foreign Application Priority Data

Mar. 18, 1987 [JP] Japan ..... 62-60982
Mar. 25, 1987 [JP] Japan ..... 62-68899

[51] Int. Cl.[5] ..... H05H 13/04
[52] U.S. Cl. ..... 328/235
[58] Field of Search ..... 328/235

[56] References Cited

U.S. PATENT DOCUMENTS 4,751,470 6/1988 Ikegami et al. ..... 328/235 X

FOREIGN PATENT DOCUMENTS 0265797 10/1987 European Pat. Off. .
3148100 6/1983 Fed. Rep. of Germany .
3530446 3/1986 Fed. Rep. of Germany .
3703938 9/1987 Fed. Rep. of Germany .

OTHER PUBLICATIONS

"Electron Microscopic Observation . . . in 99.999 wt % Single-Crystal Aluminum," by Shi et al., *Journal De Physique,* Colloque C10, Supplement Au No. 12, Tome 46, Dec. 1985, pp. C10-355-358.
"Design of UVSOR Storage Ring", UVSOR-9, Dec. 1982, pp. 56,57.
"Proceeding of the 5th Symposium on Accelerator Science and Technology," 1984, pp. 234-236.
"Sor-Ring: An Electron Storage Ring Dedicated to Spectroscopy," by T. Miyahara et al., *Particle Accelerators,* vol. 7, No. 3, pp. 163-175, 1976.

*Primary Examiner*—Palmer C. DeMeo
*Attorney, Agent, or Firm*—Antonelli, Terry, Stout & Kraus

[57] ABSTRACT

An industrial compact synchrotron radiation source includes, for the purpose of prolonging lifetime of a charged particle beam, beam absorbers made of a material having a low photodesorption yield and disposed inside a bending section/vacuum chamber at at least positions upon which the synchrotron radiation is irradiated, and electrically conductive beam stabilizers disposed at positions inside the bending section/vacuum chamber which are distant by a predetermined distance from an orbit of the charged particle beam toward the outer circumferential wall of the bending section/-vacuum chamber.

11 Claims, 7 Drawing Sheets

SYNCHROTRON RADIATION SOURCE

CROSS-REFERENCES TO RELATED APPLICATIONS

This invention is related to co-pending U.S. Patent Application Ser. No. 07/155,120, filed Feb. 11, 1988, now U.S. Pat. No. 4,853,640, and entitled "Synchrotron Radiation Source" (based on Japanese Patent Application Nos. 62-28281, 62-60981 and 62-181015).

BACKGROUND OF THE INVENTION

This invention relates to a synchrotron radiation SR source and more particularly to a SR source having beam absorbers suitable for realizing its compactness.

As discussed in "Proceeding of the 5th Symposium on Accelerator Science and Technology" in the high energy laboratory reports, 1984, pp. 234–236, conventional accelerators and large-scale SR sources are known wherein bending sections, each of which deflects the orbit of a charged particle beam for causing the synchrotron radiation to be taken out of the source, are not collectively disposed in a relatively short range of the beam duct or bending duct, but disposed with spaces between them where straight sections are disposed so that the bending sections are uniformly distributed as a whole in the beam duct or bending duct.

Accordingly, sources of gases discharged from the interior wall surface of the vacuum chamber under the irradiation of synchrotron radiation are substantially uniformly distributed along the orbit of the charged particle beam. Gases discharged from the bending sections under the irradiation of the synchrotron radiation can be evacuated not only by built-in pumps installed inside the charged particle bending section but also vacuum pumps installed in an adjacent straight section, thereby ensuring that the vacuum chamber can be maintained at high vacuum and a long lifetime of the charged particle beam can be maintained.

Conventionally, portions irradiated directly with the synchrotron radiation are made of a stainless steel material or an aluminum alloy material. When irradiated with the synchrotron radiation, the above material discharges a large amount of gases under the influence of the photo-excitation reaction.

Since the amount of discharged gases is very large amounting to 10 to 100 times the outgassing amount due to mere thermal discharge, a great number of vacuum pumps must be installed in order to maintain the interior of the vacuum chamber at a high vacuum.

Further, when the bending angle of the charged particle beam obtained by one tending section is designed to be large for the sake of realizing compactness of the SR source, the amount of gases discharged from one bending section is increased and a great number of vacuum pumps must be installed. However, because of a limited installation space, the number of pumps to be installed is limited, raising a problem that the interior of the vacuum chamber can not be maintained at high vacuum and the lifetime of the charged particle beam is shortened.

Moreover, in compact SR sources for industrial purposes, because cost reduction is desirable, the bending section for delivery of synchrotron radiation has to be laid concentratedly.

Taking a compact SR source comprised of two straight sections and two bending sections, for instance, it is necessary for one bending section to 180° deflect the charged particle beam orbit and as a result, the amount of gases generated by each bending section under the irradiation of synchrotron radiation upon the interior wall surface of a portion of the vacuum chamber corresponding to one bending section is greatly increased, reaching about 10 times the amount of discharged gases generated by each bending section in the case of a large-scale SR source.

Accordingly, if the configuration of the vacuum chamber and the layout of vacuum pumps in the large-scale SR source are directly applied to the compact SR source without alternation, then there will arise a problem that pressure in the vacuum chamber rises and the lifetime of the charged particle beam is shortened.

A countermeasure for solving the above problems has been proposed wherein the shape of the bending section/vacuum chamber is made different from the conventional duct form of the bending section/vacuum chamber of the large-scale SR source so as to take the form of a sector or a semi-circle and in addition, vacuum pumps are installed near the outer circumferential wall of the bending section/vacuum chamber and SR guide ducts extend from the outer circumferential wall. With this proposal, the vacuum evacuation performance can be comparable or superior to that of the conventional large-scale SR source but disadvantageously the orbit of the charged particle beam tends to be unstable.

More particularly, the sector or semi-circular form of the bending section/vacuum chamber tends to adversely interfere with the orbit of the charged particle beam guided to the bending section, thereby inducing a high-frequency electric field (called a wake field) which makes the orbit of the charged particle beam unstable.

SUMMARY OF THE INVENTION

The present invention contemplates elimination of the above problems and has for its object to provide a SR source having beam absorber so as to be suited to serve as a compact SR source capable of prolonging the lifetime of the charged particle beam or a SR source being capable of making stable the orbit of the charged particle beam so as to prolong lifetime of the synchrotron radiation.

According to the invention, the above object can be accomplished by disposing beam absorbers made of a material of low photodesorption yield inside the bending section/vacuum chamber at least at positions upon which the synchrotron radiation is irradiated or by disposing electrically conductive beam stabilizers at positions inside the bending section/vacuum chamber which are a predetermined distance from the charged particle beam orbit toward the outer circumferential wall of the bending section/vacuum chamber.

The low photodesorption yield material discharges a small amount of gases under the irradiation of photons and is preferably required to have a photodesorption yield of $10^{-6}$ molecules/photon or less in order to meet the present invention.

As the low photodesorption material, a material having a high purity of 99.99% or more and (or) having a single crystalline structure such as, for example, a vacuum-degassed material may preferably be used. Referring specifically to the purity, copper or aluminum of more than 99.99% purity may be used.

Beam absorbers made of the low photodesorption yield material are disposed at positions upon which the synchrotron radiation is irradiated, in order to suppress the generation of gases within the vacuum chamber. The amount of gases discharged from the surface or the interior of the low photodesorption yield material by photo-excitation reaction under the irradiation of the synchrotron radiation is small and accordingly the interior of the vacuum chamber can be maintained at high vacuum with the view of prolonging the lifetime of the charged particle beam.

Particularly, a high-purity material of 99.99% or more used as the low photodesorption yield material is featured in that not only is there no gas discharged from crystal grain boundaries within the material but also the amount of gases persisting as solid solution in crystal is small.

When copper or aluminum is used as the low photodesorption yield material, the amount of gases discharged from this material under the irradiation of the synchrotron radiation is small and, thanks to high thermal conductivity, the copper or aluminum material can easily be cooled to suppress heat generation therein due to the irradiation of the synchrotron radiation.

On the other hand, by disposing electrically conductive beam stabilizers at positions inside the bending section/vacuum chamber which are a predetermined distance (for example, the distance between the charged particle beam orbit and the inner circumferential wall of the vacuum chamber) from the charged particle beam orbit toward the outer circumferential wall of the vacuum chamber, the bending section/vacuum chamber having a cross-sectional form which expands two-dimensionally can electrically be treated as a straight section beam duct having a nearly circular or elliptical cross-sectional form, so that the charged particle beam orbit can be made stable which would otherwise be disturbed by the induced wake field. Thanks to the stable charged particle beam orbit, the charged particle beam will not be attenuated by deviating from the orbit to the interior wall surface of the vacuum chamber and its lifetime can be prolonged.

DESCRIPTION OF THE PREFERRED EMBODIMENTS

The invention will now be described by way of example with reference to the accompanying drawings.

Figure 1:
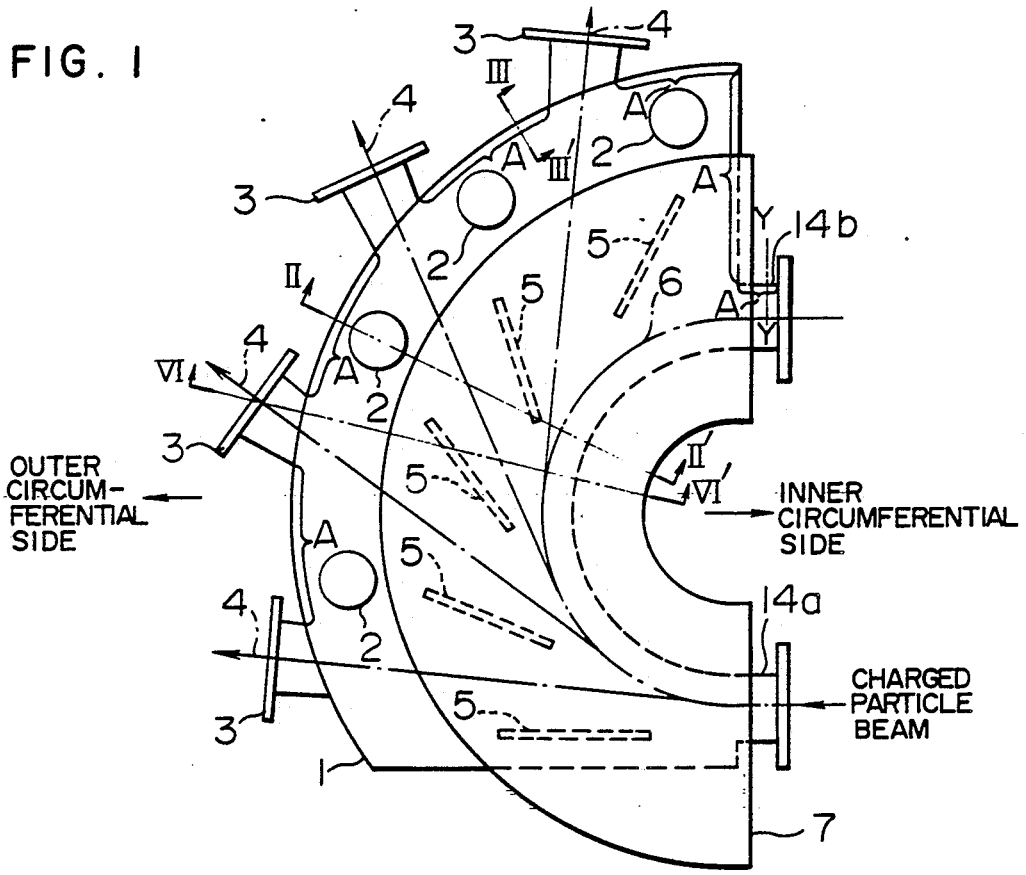
FIG. 1 is a plan view illustrating a SR source having beam absorbers according to an embodiment of the invention.

Referring to FIG. 1, there is illustrated, in plan view form, the half of a beam duct of a compact SR source according to an embodiment of the invention. In FIG. 1, a bending section/vacuum chamber (hereinafter simply referred to as a vacuum chamber) 1 has the form of a semi-circular ring approximating a C shape, having one end which a charged particle beam enters and the other end which the charged particle beam leaves. The outer circumferential wall of the vacuum chamber 1 extends beyond the outer circumferential edge of a core 7 of a bending electromagnet (FIG. 2) to provide an extension from which four SR guide ducts 3 for delivery of the SR beam extend and on which four pump sets 2 are installed. For simplicity of production of the vacuum chamber 1, the vacuum pump sets 2 are disposed at equal circumferential intervals.

Inside the vacuum chamber 1, elongated supports 5 bridge the upper and lower walls of the vacuum chamber and protrude through these walls to support the bending electromagnet. The supports 5 longitudinally extend, at positions remote from the outer circumferential wall of the vacuum chamber 1, in a direction which is parallel to the SR beam so as to escape the irradiation of the SR beam directed to the SR guide ducts 3.

Figure 2:
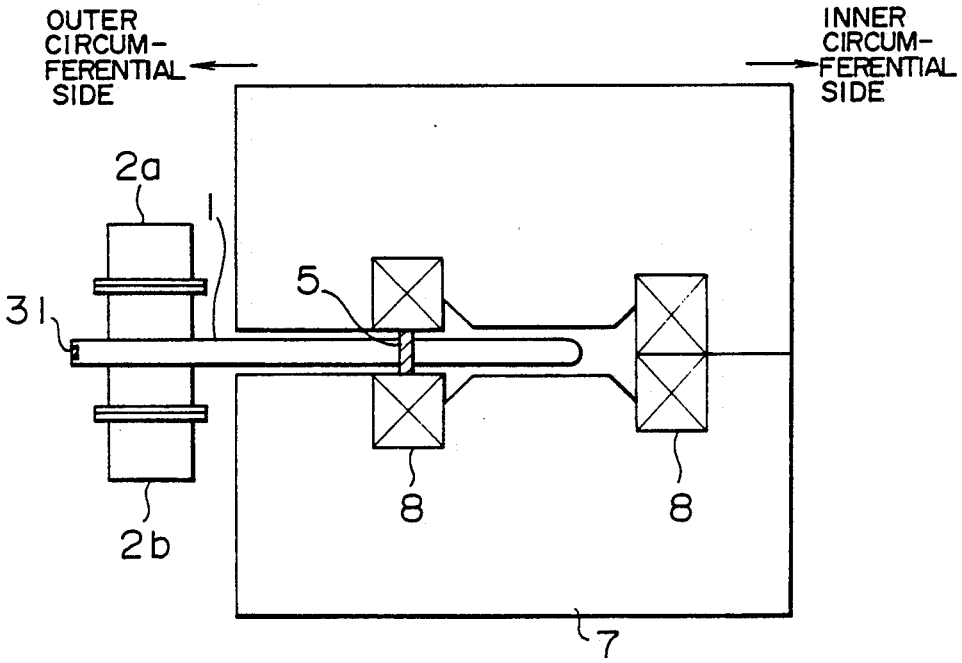
FIG. 2 is a sectional view taken on the line II–II' of FIG. 1.

For better understanding of the overall construction of the vacuum chamber 1, reference should be made to FIG. 2. In this illustration, the bending electromagnet is designated by reference numeral 8 and associated with the core 7 to form a magnetic circuit.

The vacuum chamber 1 is inserted between upper and lower halves of the core 7 and bending electromagnet 8, and the bending electromagnet 8 is supported by the supports 5 which vertically protrude through the vacuum chamber 1.

An ion pump 2*a* and a titanium getter pump 2*b* of each vacuum pump set 2 are respectively mounted to the upper and lower and surfaces contiguous to the outer circumferential wall of the vacuum chamber 1. Since the vacuum pump sets 2 are mounted to the end portion in this way, their interior can obviously escape the direct irradiation of the S beam 4.

At positions inside the vacuum chamber 1, particularly on portions A shown in FIG. 1 on the interior surface of the peripheral wall of the vacuum chamber 1 which are directly irradiated with the synchrotron radiation, beam absorbers 31 made of a single crystalline material are disposed. The beam absorber 31 is mounted as detailed in FIG. 3.

Figure 3:
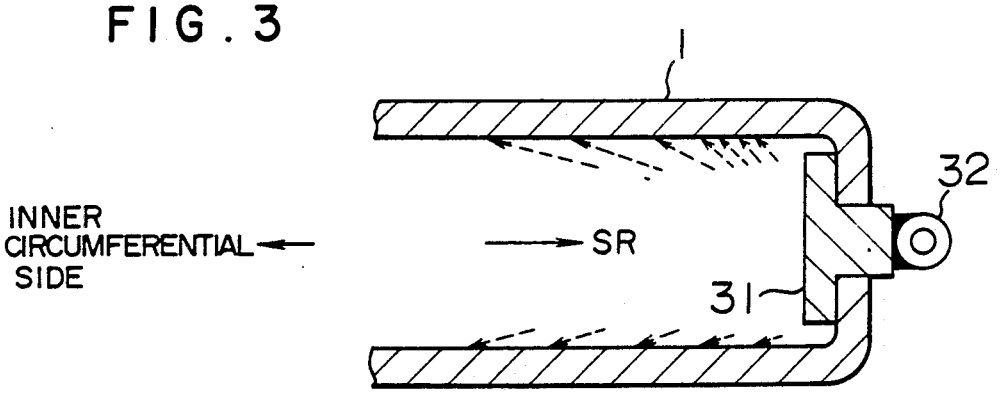
FIG. 3 is a sectional view taken on the line III–III' of FIG. 1.

Referring to FIG. 3, the beam absorber 31 is fixedly mounted on the interior surface of the peripheral wall, especially, the outer circumferential wall in the illustration, having one end which protrudes through the wall of the vacuum chamber 1 so as to be connected to a water cooling pipe 32 by brazing. The beam absorber 31 makes an airtight connection is to the vacuum chamber 1 by welding or brazing.

The configuration of the support 5 will now be detailed with reference to FIG. 4. The support 5 shown in FIG. 1 is positionally related to an orbit 6 of the charged particle beam and the synchrotron radiation 4, as diagrammatically shown in FIG. 4.

Figure 4:
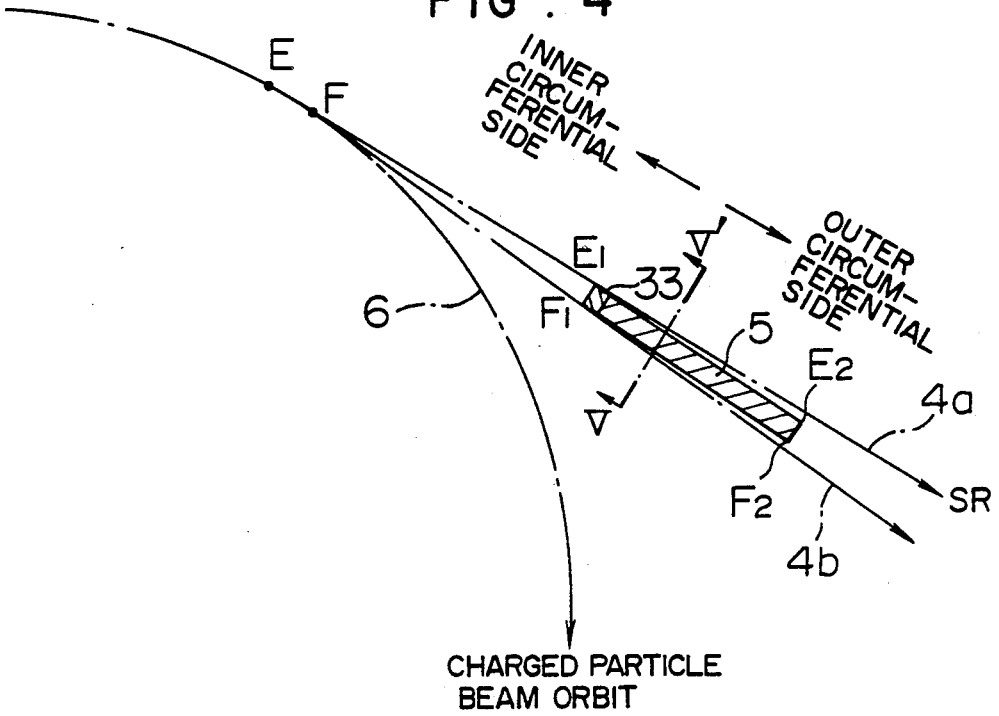
FIG. 4 is an enlarged fragmentary view of FIG. 1.

A beam absorber 33 of a single crystalline material is fixedly mounted to the inner end, close to the inner circumferential wall of the vacuum chamber, of the support 5, as shown in FIG. 4, and SR beams 4*a* and 4*b* respectively stemming from points E and F on the charged particle beam orbit 6 reach end points $E_1$ and $F_1$ of the beam absorber 33. Line segments $EE_1$ and $FF_1$ are representative of tangents at the points E and F on the orbit 6, respectively, and coincide with the trace of the SR beams. End points $E_2$ and $F_2$, close to the outer circumferential wall of the vacuum chamber, of the support 5 lie within a region between extensions of the line segments $EE_1$ and $FF_1$, so that opposite side surfaces $E_1E_2$, $F_1F_2$ and the outer end surface $E_2F_2$ can escape the direct irradiation of the radiation 4.

Figure 5:
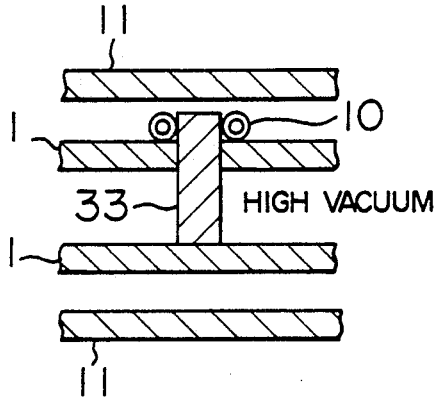
FIG. 5 is a sectional view taken on the line V–V' of FIG. 4.

Since the synchrotron radiation 4 directly irradiates the beam absorber 33 on the inner end of the support 5, the beam absorber 33 is cooled so as not to be heated under exposure to the radiation 4. Thus, as shown in FIG. 5, one end of beam absorber 33 vertically protruding through the vacuum chamber 1 is connected to a water cooling pipe 10 in a space between a coil vacuum chamber 11 and the vacuum chamber 1.

Returning to FIG. 1, the opposite ends of the vacuum chamber 1 are connected to straight section ducts 14*a* and 14*b*, respectively. The synchrotron radiation does not irradiate the straight section duct 14*a* near the entrance of the charged particle beam but it irradiates the interior surface of the outer wall of the straight section duct 14*b* near the exit. Accordingly, a beam absorber 31 having the same construction as that illustrated in FIG. 3 is mounted to that interior surface.

Figure 6:
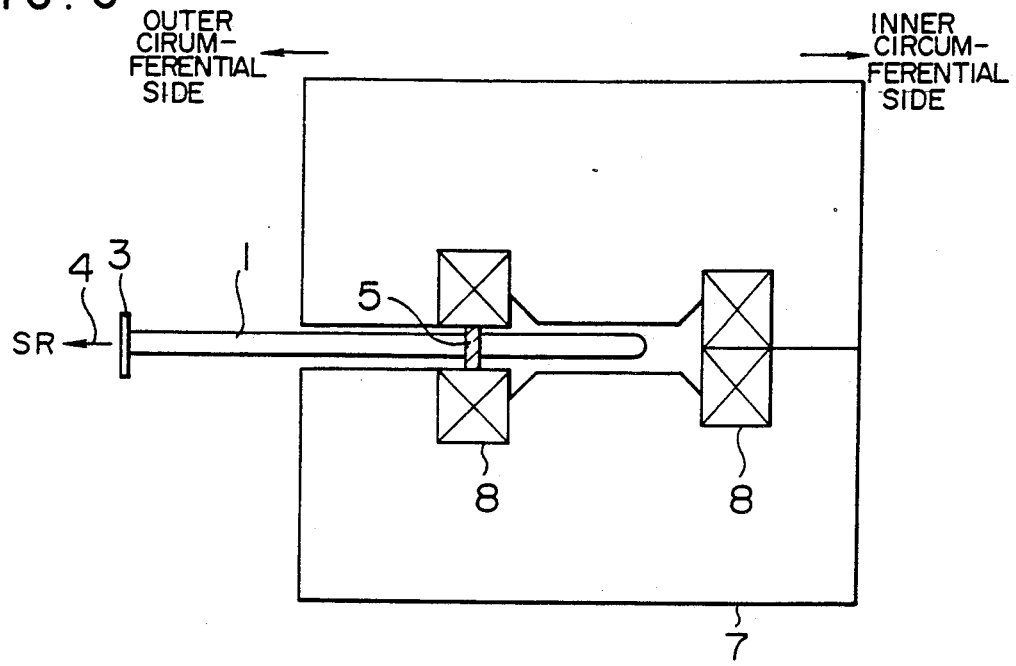
FIG. 6 is a sectional view taken on the line VI–VI' of FIG. 1.

The SR guide duct 3 extending from the outer circumferential wall of the vacuum chamber 1 is positionally related to the vacuum chamber 1, as illustrated in FIG. 6.

The operation and effect of this embodiment will now be described.

As shown in FIG. 1, a charged particle beam entering the bending section/vacuum chamber 1 traces the nearly circular orbit 6 under the influence of a magnetic field generated from the bending electromagnet and leaves the exit of the vacuum chamber 1.

The synchrotron radiation 4 is radiated tangentially of the charged particle beam orbit 6. The radiation 4 is partly guided to the outside through the SR guide duct 3 and partly irradiated directly on the portions A on the interior surface of the peripheral wall of the vacuum chamber and the inner end surface of the support 5. But, since the beam absorbers 31 and 33 made of a single crystalline material having no crystal grain boundary and a small amount of gases persisting as solid solution in crystal are disposed on these portions, the amount of gases generated in the vacuum chamber can be minimized. Although the beam absorbers 31 and 33 are heated by the irradiation of the synchrotron radiation, these beam absorbers of the FIG. 1 embodiment are made of copper of high thermal conductivity, especially, vacuum-molten (vacuum degassed) 99.99% or more high-purity copper and hence can easily be cooled with water. Obviously, a beam absorber made of an aluminum single crystalline material can attain the same effect.

Most of the SR beams 4 leaving the charged particle beam orbit 6 reach the interior surface of the outer circumferential wall of the vacuum chamber 1. Accordingly, sources of gases discharged by secondary electrons stemming from the beam absorbers 31 and 33 irradiated with the synchrotron radiation 4 also lie on the interior surface of the outer circumferential wall which is remote from the charged particle beam orbit 6. All of the generated gases are evacuated by vacuum pump sets 2 which are disposed near the gas discharge sources and are able to afford to have a large effective evacuation rate. The interior of the vacuum chamber 1 can be advantageously maintained at high vacuum without adversely affecting the charged particle beam orbit 6. Thus, lifetime of the charged particle beam can be prolonged.

As described in connection with FIG. 4, the support 5 extends substantially in parallel to the SR beam and only the beam absorber 33 on its inner end surface is irradiated directly with the radiation with the result that the amount of gas discharged from the support 5 under the irradiation of the synchrotron radiation can be minimized. Usually, the material surface is thermally excited to discharge gases but the outgassing rate in thermal discharge is about 1/100 of that in direct irradiation by the synchrotron radiation and need not be considered particularly.

Another embodiment of the bending section/vacuum chamber according to the invention will now be described with reference to FIGS. 7 and 8.

Figure 7:
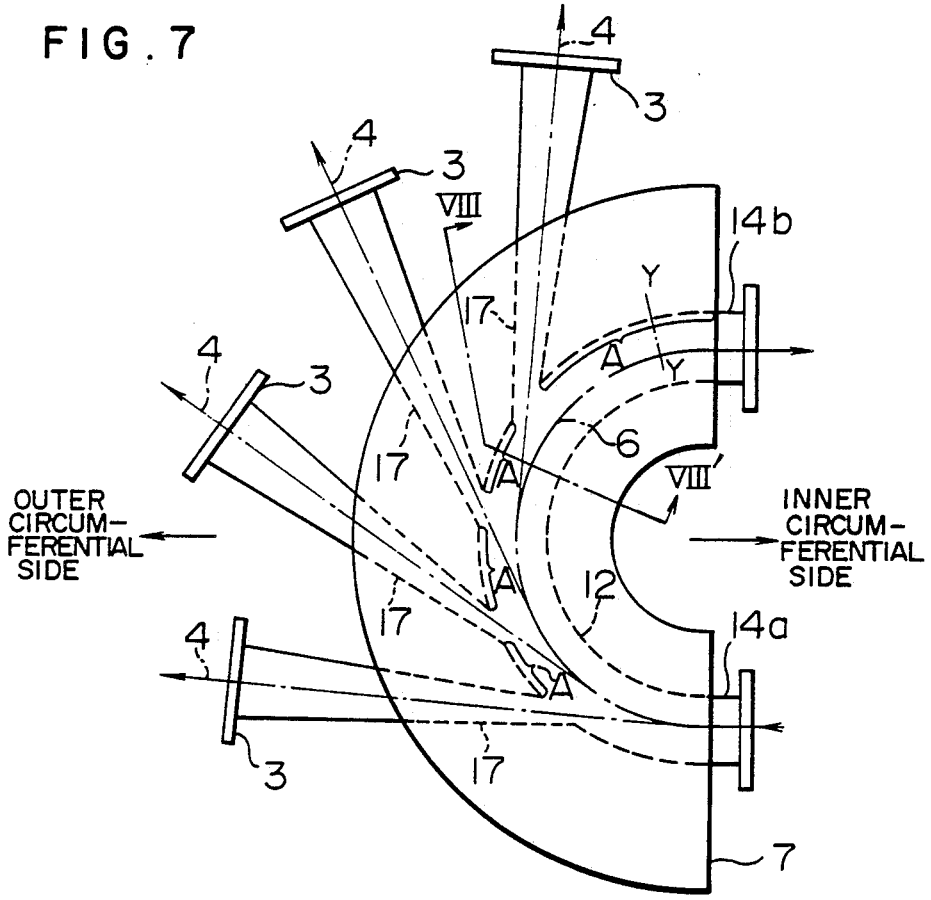
FIG. 7 is a plan view illustrating a SR source having beam absorbers according to another embodiment of the invention.

In FIG. 7, members having the same functions as the members of FIG. 1 are designated by identical reference numerals.

Referring to FIG. 7, 12 is a bending section/vacuum chamber (hereinafter simply referred to as bending section 12) having substantially the same cross-sectional configuration as that of a straight section duct 14*a* near the entrance of the charged particle beam. The bending section 12 is provided with four SR guide ducts 17, and beam absorbers 31 made of a copper single crystalline material are disposed at portions A on the interior surface of the outer circumferential wall of bending section 12 which are irradiated directly with the synchrotron radiation.

Although not shown, vacuum pump sets 2 each comprised of upper and lower pumps are mounted to the SR beam guide ducts 17 outwardly of the outer circumferential edge of a core 7 in the same manner as described in connection with the vacuum pump sets 2 of FIG. 2.

The configuration of the bending section 12 will be detailed with reference to FIG. 8.

Figure 8:
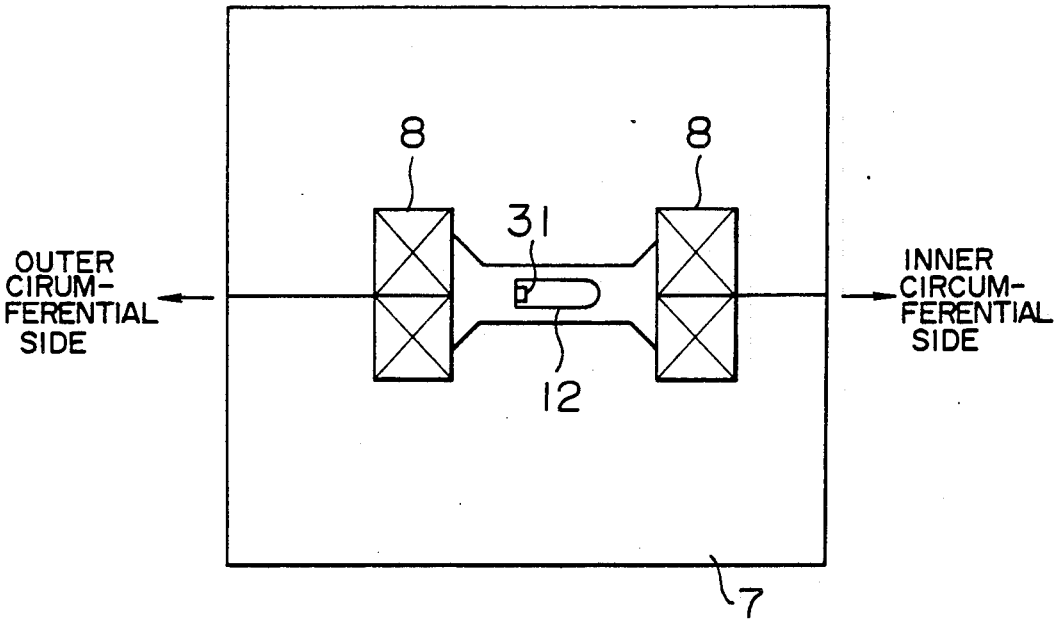
FIG. 8 is a sectional view taken on the line VIII–VIII' of FIG. 7.

As shown in FIG. 8, the bending section 12 is laid in a space encompassed with a bending electromagnet 8 and the core 7. Beam absorbers 31 are disposed at portions on the interior surface of the outer circumferential wall of the bending section 12 and cooled with water through a water cooling system, not shown.

The operation and effect of this embodiment will now be described. Since the bending section 12 shown in FIG. 7 has substantially the same cross-sectional configuration as that of the straight section ducts 14*a* and 14*b*, stability of an orbit 6 of the charged particle beam can be improved. In addition, the beam absorbers 31 disposed at portions upon which the SR beam is irradiated directly can suppress the outgassing amount to a minimum, thereby prolonging lifetime of the charged particle beam.

Further, in this embodiment, the evacuation system (not shown) comprised of the vacuum pump sets 2 mounted to the SR guide ducts 17 and vacuum pumps installed in the straight section ducts may additionally include built-in pumps installed near the inner circumferential wall of the bending section 12.

High purity of the single crystalline material of the beam absorber is effective to minimize the amount of gases discharged under the irradiation of the synchrotron radiation.

Obviously, by disposing additional beam absorbers near the portions irradiated directly with the synchrotron radiation, in addition to the beam absorbers disposed at those portions, the vacuum evacuation performance can further be improved.

Advantageously, the vacuum pump sets installed outwardly of the outer circumferential edge of the core can be inspected for maintenance with ease.

It should be understood that the SR beam irradiating the beam absorber 31 is reflected therefrom as shown at dotted line in FIG. 3 and reflected beams irradiate the interior surface of the vacuum chamber 1. Energy intensity of the reflected beam is smaller than that of the incident SR beam but the irradiation of the reflected beam is sufficient to discharge gases from the interior surface. Accordingly, by disposing beam absorbers at portions upon which the reflected beams are irradiated, the vacuum evacuation performance can further be improved.

A bending section/vacuum chamber according to still another embodiment of the invention incorporates beam stabilizers as will be described below with reference to the drawings.

Figure 9:
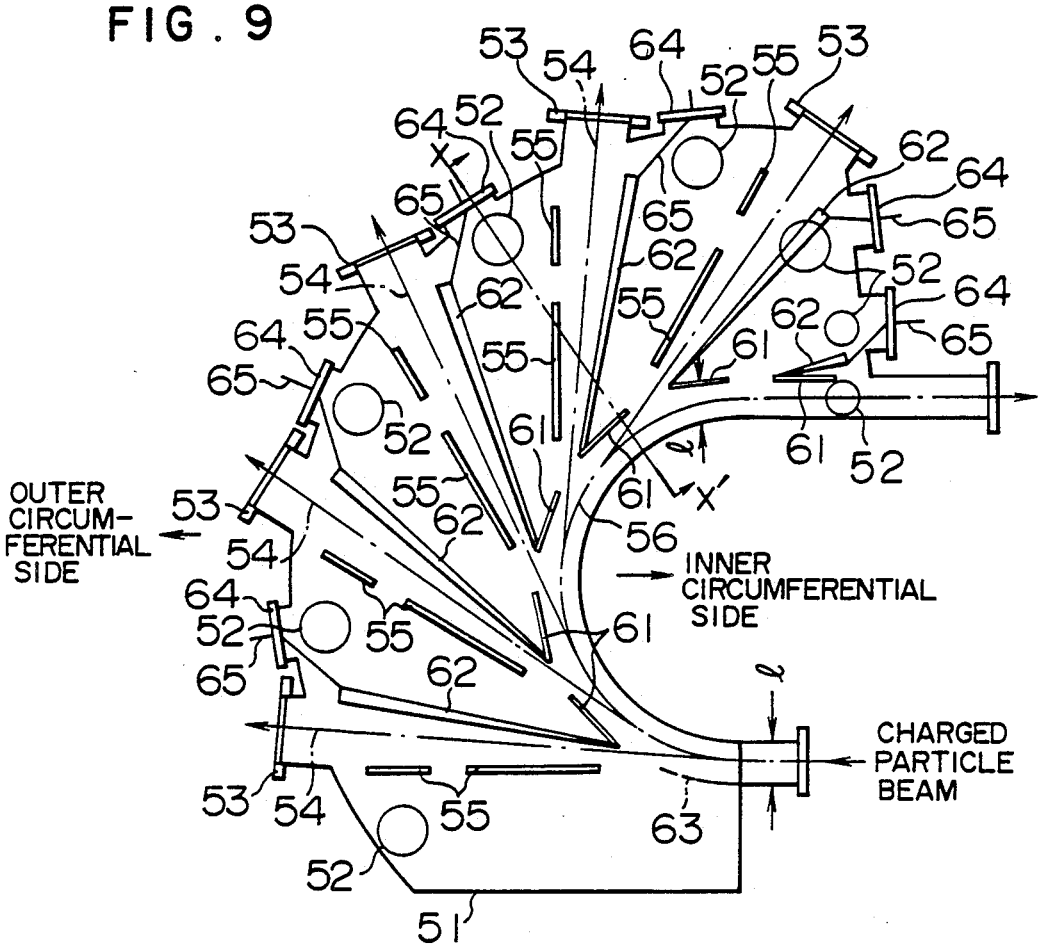
FIG. 9 is a plan view illustrating a SR source having beam stabilizers according to still another embodiment of the invention.

FIG. 9 illustrates, in plan view form, a bending section/vacuum chamber of industrial compact SR source. In FIG. 9, the bending section/vacuum chamber, simply referred to as vacuum chamber 51 hereinafter, has the form of a substantially C-shaped semi-circle and has one end at which a charged particle beam enters the vacuum chamber and the other end at which the charged particle beam leaves the vacuum chamber. The outer circumferential wall of the vacuum chamber 51 protrudes beyond the outer circumferential edge of a core of a bending electromagnet (not shown) to provide an extension from which five SR guide ducts 53 for delivery of the synchrotron radiation extend and at which eight vacuum pump sets 52 are installed.

Inside the vacuum chamber 51, elongated supports 55 bridge the upper and lower walls of the vacuum chamber and protrude through these walls to support the bending electromagnet. The supports 55 longitudinally extend, at positions remote from the outer circumferential wall of the vacuum chamber 51, in a direction which is parallel to the SR beam. Each support 55 is provided at a position intermediate to adjacent two of the SR guide ducts 53.

Also installed inside the vacuum chamber 51 are six beam stabilizers 61 made of copper and insert plates 62 made of stainless steel serving as supports for the beam stabilizer 61 and also as supports for the side walls of the vacuum chamber. Each insert plate 62 is connected with a water cooling pipes 65 adapted to cool each beam stabilizer 61. The beam stabilizer 61, insert plate 62 and water cooling pipes 65 are put together to form an assembly which can be inserted into the vacuum chamber 51 through an insertion port 64 formed in the outer circumferential wall of the vacuum chamber. The beam stabilizers 61 are disposed at positions which are distant by a distance l (equal to the width of the straight section beam duct) from the inner circumferential wall of the vacuum chamber 51, and the orbit of a charged particle beam is so controlled as to be centered between each beam stabilizer 61 and the inner circumferential wall.

Figure 10:
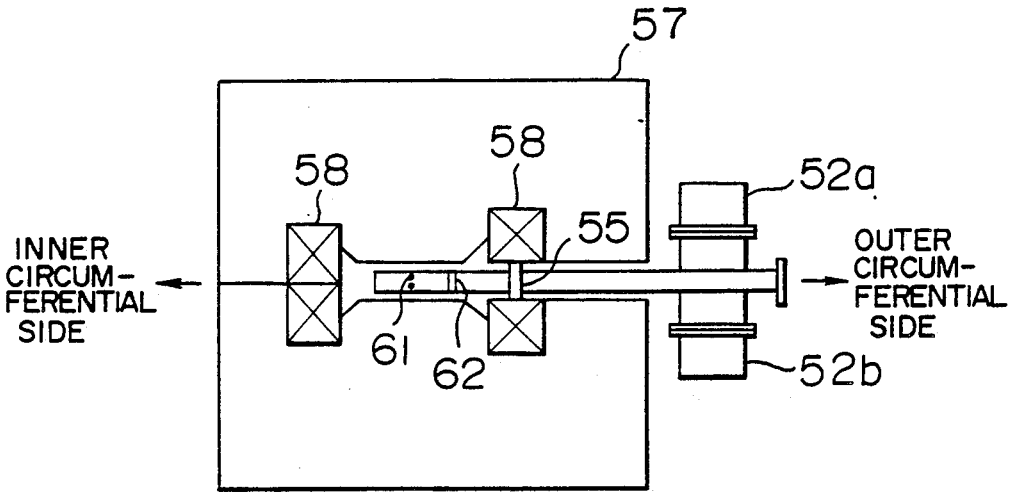
FIG. 10 is a sectional view taken on the line X–X' of FIG. 9.

For better understanding of the overall construction of the vacuum chamber 51, reference should be made to FIG. 10. In FIG. 10, the vacuum chamber of FIG. 9 is sectioned along the line X—X and the bending electromagnet is designated by reference numeral 58 and associated with the core as designated by 57 to form a magnetic circuit.

The vacuum chamber 51 is inserted between upper and lower halves of the core 57 and bending electromagnet 58 and the bending electromagnet 58 is supported by the supports 55 which vertically protrude through the vacuum chamber 51.

Ion pump **52*a* and titanium getter pump 52*b* of each vacuum pump set 52 are respectively mounted to the upper and lower end surfaces contiguous to the outer circumferential wall of the vacuum chamber 51. Since the vacuum pump sets 52 are mounted to the end portion in this way, their interior can obviously escape the direct irradiation of synchrotron radiation 54**.

As described previously, the beam stabilizers 61 and insert plates 62 are also installed within the vacuum chamber 51.

The configuration of the beam stabilizer 61 will now be detailed with reference to FIGS. 11 to 14. The beam stabilizer 61 shown in FIG. 9 is positionally related to an orbit 56 of the charged particle beam and the synchrotron radiation 54, as diagrammatically shown in FIG. 11.

SR beams **54*a* and 54*b* respectively stemming from points $A_1$ and $B_1$ on the charged partial beam orbit 56 reach end points $A_2$ and $B_2$, close to the insert plate 62, of the beam stabilizer 61. Line segments $A_2A_1$ and $B_2B_1$ are representative of tangents at the points $A_1$ and $B_1$ on the orbit 56**, respectively, and coincide with the trace of the SR beams.

Since the insert plate 62 supporting the beam stabilizer 61 lies within a region between extensions of the line segments $A_2A_1$ and $B_2B_1$, opposite side surfaces and the outer end surface of the insert plate 62 can escape the direct irradiation of the synchrotron radiation.

The insert plate 62 has a height equal to an inner height of the vacuum chamber 51, and the beam stabilizer 61 is internally hollowed to form a cross-sectionally rectangular cavity and is suspended within the vacuum chamber 51. The water cooling pipe 65 is fixedly attached by welding to the insert plate 62 and beam stabilizer 61. The above construction will be described more specifically with reference to FIGS. 12 to 14.

Figure 11:
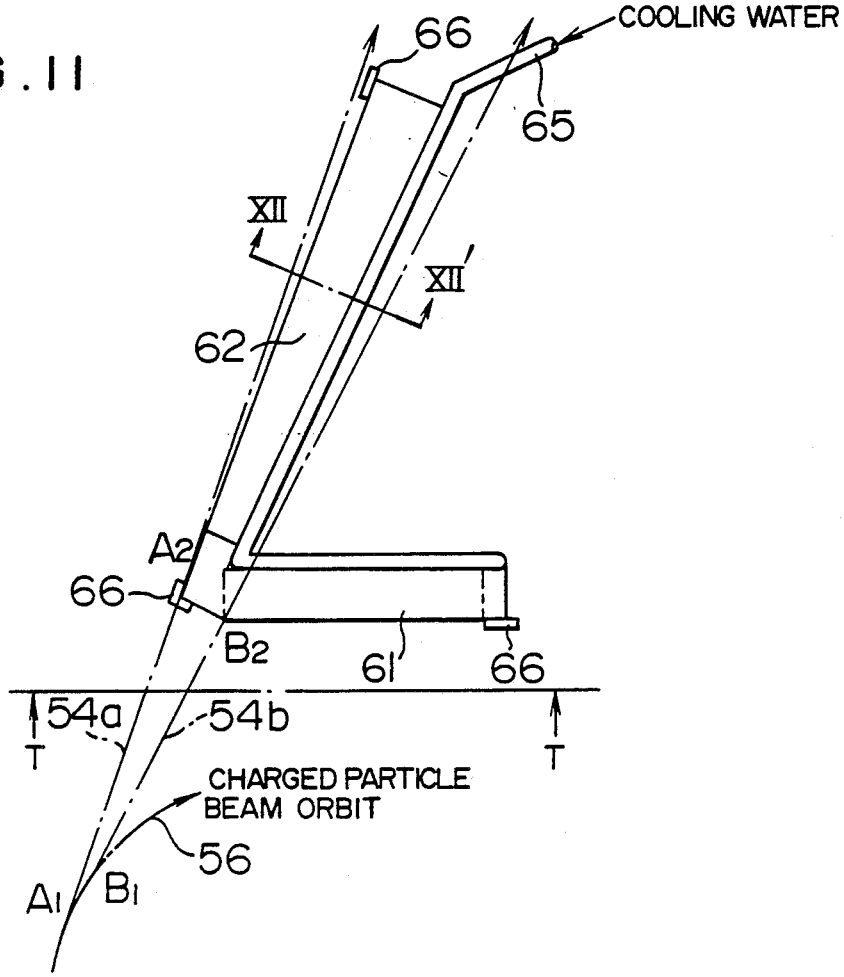
FIG. 11 is an enlarged fragmentary view of FIG. 9.
Figure 12:
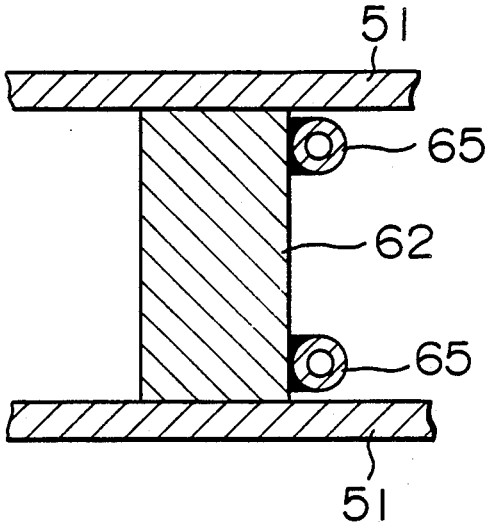
FIG. 12 is a sectional views taken on the line XII–XII' of FIG. 11.

FIG. 12 is a sectional view taken on the line XII–XII' of FIG. 11, demonstrating the positional relation of the insert plate 62 to the vacuum chamber. The upper and lower ends of the insert plate 62 are in contact with the interior surface of the vacuum chamber 51 but they are not fixed thereto by, for example, welding so that the insert plate 62 can be inserted into the vacuum chamber 51 through the insertion port 64 in the outer circumferential wall in airtight fashion. Two sections of the water cooling pipe 65 are fixed by welding to the upper and lower end sides of the insert plate 62.

Figure 13:
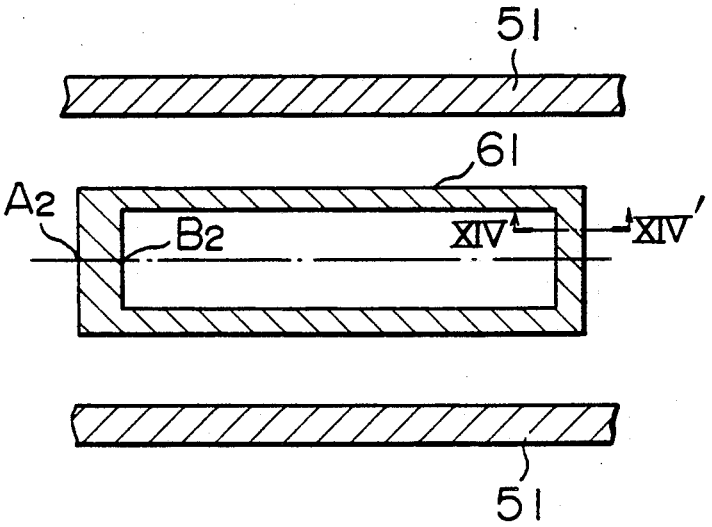
FIG. 13 is a view as seen in the direction of arrows T in FIG. 11.
Figure 14:
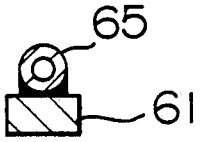
FIG. 14 is a sectional view taken on the line XIV–XIV' of FIG. 13.

FIG. 13 is a view as seen in a direction of arrows T in FIG. 11, demonstrating the positional relation of the beam stabilizer 61 to the vacuum chamber. As described previously, the beam stabilizer 61 has the rectangular cavity and it is suspended within the vacuum chamber 51, leaving behind upper and lower spaces as illustrated in FIG. 13. The water cooling pipe 65 is also fixed by welding to the outer (back) surface of the beam stabilizer 61, as best seen from a XIV–XIV' section of FIG. 13 illustrated in FIG. 14.

Returning to FIG. 11, upper and lower hooks 66 are provided on the interior surface of the vacuum chamber 51 and act to effect positioning of end corners of the beam stabilizer 61 and the insert plate 62. Although not shown, the height of each hook 66 is not so large as to bridge the vacuum chamber 51 but is designed to take a value which is sufficient for positioning of the beam stabilizer 61 and insert plate 62, measuring 3 to 5 mm, for example. Accordingly, the SR beam does not irradiate the hook 66 directly.

The operation and effect of this embodiment will now be described.

As shown in FIG. 9, a charged particle beam entering the bending section/vacuum chamber 51 traces the nearly circular orbit 56 under the influence of a magnetic field generated from the bending electromagnet and leaves the exit of the vacuum chamber 51. The synchrotron radiation 54 is radiated tangentially of the charged particle beam orbit 56. The radiation 54 is partly guided to the outside through the SR guide duct 53 and partly irradiated directly on the inner end of the support 55, the inner surface of the beam stabilizer 61 and the interior surface of the outer circumferential wall of the vacuum chamber 51 to cause outgassing of a large amount of gaseous molecules on the basis of the photo-excited separation phenomenon. The area of the interior surface of outer circumferential wall of vacuum chamber 51 is much larger than the area of the other portion. Therefore, most of gases prevailing in the vacuum chamber 51 are discharged from a gas discharge source on the interior surface of the outer circumferential wall.

Since a number of vacuum pump sets 52 disposed close to the outer circumferential wall of vacuum chamber 51 then lie in the vicinity of the gas discharge source, discharged gaseous molecules can immediately be evacuated to the outside of the SR source.

The vacuum pump sets 52 disposed near the gas discharge source can have a larger effective evacuation rate than is disposed at other site and advantageously the SR source can be maintained under high vacuum condition and lifetime of the charged particle beam can be prolonged. Most of gas discharge sources are remote from the charged particle beam orbit 56 and gases discharged from these sources can hardly affect the charged particle beam adversely.

The stability of the charged particle beam orbit will particularly be described. The width l and height of the straight section beam duct are designed through analysis of a wake field in the straight section so as to take values by which the charged particle beam orbit can be stabilized. But due to the fact that the configuration of the bending section/vacuum chamber 51 is expanded two-dimensionally in contrast to that of the straight section, the wake field in the vacuum chamber can not be analized accurately and the charged particle beam orbit tends to be unstable. In the present embodiment, however, the charged particle beam orbit 56 in the bending section is established in a space which is defined by an inner contour corresponding to the inner circumferential wall of the vacuum chamber 51 and an outer contour corresponding to the beam stabilizers 61 and therefore, the bending section/vacuum chamber can electrically be treated as the straight section beam duct.

Accordingly, the charged particle beam orbit 56 can be stable in the vacuum chamber as in the straight section.

Further, the beam stabilizer 61 is hollowed to form a cross-sectionally rectangular cavity which has a small area irradiated with the synchrotron radiation and besides it is made of a copper material from which a small amount of gases is discharged under the irradiation of the synchrotron radiation. Accordingly, even with the beam stabilizers 61 disposed inside the vacuum chamber 51, the interior of the vacuum chamber can be maintained at high vacuum and lifetime of the charged particle beam can be prolonged.

At the commencement of the rise of the charged particle beam, the charged particle beam orbit goes through the vacuum chamber 51 at a height which is about $\frac{1}{2}$ of the inner height of the vacuum chamber. On the other hand, the cross-sectionally rectangular cavity is centered with the beam stabilizer 61 per se as will be seen from FIG. 13 and therefore the synchrotron radiation will irradiate only a part of either end of the beam stabilizer 61, with the result that the amount of gases discharged from the beam stabilizer 61 can be minimized and the rise time of charged particle beam can be minimized.

The beam stabilizer 61 heated by the irradiation can be cooled through the cooling water pipe 65 and its temperature rise can be suppressed to below a permissible value.

As shown in FIG. 11, one end of the insert plate 62 is encompassed with the beam stabilizer 61 to escape the direct irradiation of the synchrotron radiation 54, thereby minimizing the gas generation amount.

Advantageously, by manipulating the water cooling pipe 65, the assembly of beam stabilizer 61, insert plate 62 and water cooling pipe 65 can readily be mounted to or dismounted from the vacuum chamber through the insertion port 64 in the outer circumferential wall without resort to disassembling of the being electromagnet and the like parts.

In the present embodiment, the beam stabilizer of copper is used to minimize the outgassing amount under the irradiation of the synchrotron radiation but the beam absorber made of aluminum may be used to attain substantially the same effect.

Figure 16:
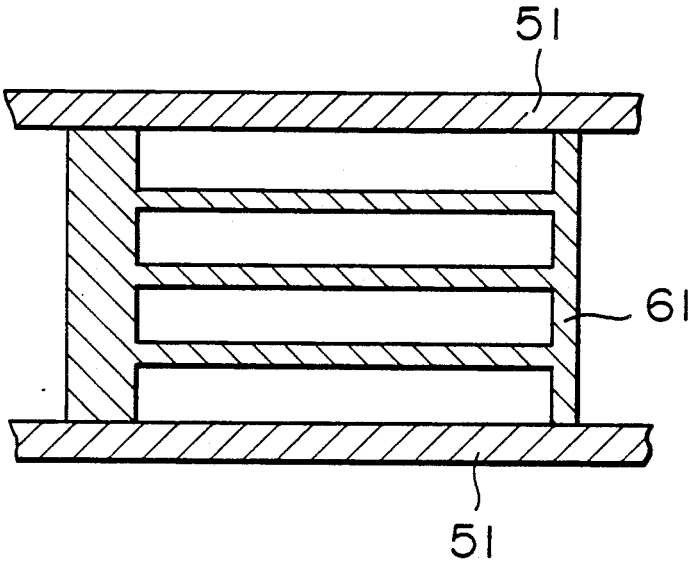

FIG. 16 illustrates another embodiment of the beam stabilizer wherein the cross-sectionally rectangular cavity shown in FIG. 13 is partitioned into two smaller cavities. With this embodiment, the gas generation amount under the irradiation is slightly increased but the stability of the charged particle beam can further be improved.

Figure 15:
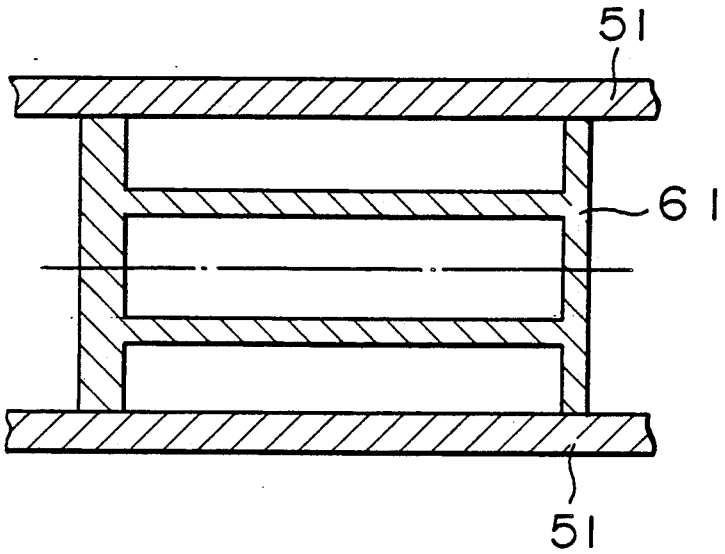
FIGS. 15 and 16 are sectional views illustrating other embodiments of the beam stabilizer.

The FIG. 16 embodiment and also still another embodiment of FIG. 15 of beam stabilizer having one cavity as in the case of the FIG. 13 embodiment are also featured in that the opposite ends of the beam stabilizer 61 are in contact with the upper and lower walls of the vacuum chamber 51 to establish an electrically closed cycle. By this configuration of FIGS. 15 and 16, the stability of the charged particle beam can further be improved. It should also be appreciated that because of the absence of the beam stabilizers at portions for delivery of the synchrotron radiation 54, distrubance of synchrotron radiation 54 due to beam stabilizer can be prevented when the charged particle beam is brought into the operation mode in which the charged particle beam is moved vertically.

As has been described, in the SR source of the present invention, the beam absorbers made of a low photo-excited separation coefficient material are disposed inside the vacuum chamber at at least positions upon which the synchrotron radiation is irradiated, so that the amount of gases discharged from the surface and the interior of the material by the photo-excitation reaction under the irradiation of the synchrotron radiation can be minimized and consequently the interior of the vacuum chamber can be maintained at high vacuum, thereby prolonging lifetime of the charged particle beam. In addition, since the electrically conductive beam stabilizers are disposed at positions inside the bending section/vacuum chamber which are distant by a predetermined distance from the charged particle beam orbit toward the circumferential wall of the vacuum chamber, the bending section/vacuum chamber having a cross-sectional form which expands two-dimensionally can electrically be treated as a straight section beam duct having nearly a circular or elliptical cross-sectional form, so that the charged particle beam orbit can be made stable which would otherwise be distrubed by the induced wake field and consequently, the charged particle beam will not be attenuated by deviating from the orbit to the interior wall surface of the vacuum chamber and its lifetime can be prolonged.

We claim:

1. A synchrotron radiation source comprising:
a bending section/vacuum chamber having one end which a charged particle beam enters and the other end which the charged particle beam leaves;
a bending electromagnet so disposed as to encompass said bending section/vacuum chamber; and
beam absorbers made of copper of more than 99.99% purity and disposed inside said bending section/-vacuum chamber at at least positions upon which the synchrotron radiation is irradiated.

2. A synchrotron radiation source according to claim 1 wherein said beam absorbers are disposed at positions irradiated with a reflection beam of the synchrotron radiation.

3. A synchrotron radiation source according to claim 1 wherein said copper of more than 99.99% purity is a vacuum-degassed material.

4. A synchrotron radiation source according to claim 1 wherein said copper of more than 99.99% purity is a single crystalline material.

5. A synchrotron radiation source according to claim 1 wherein said copper of more than 99.99% purity has a high thermal conductivity.

6. A synchrotron radiation source according to claim 1 further comprising means for cooling said beam absorbers to prevent the beam absorbers from overheating by irradiation of the synchrotron radiation.

7. A synchrotron radiation source according to claim 1, wherein said beam absorbers provided inside said bending section/vacuum chamber at those portions which are directly irradiated by synchrotron radiation generated from the charged particle beam.

8. A synchrotron radiation source according to claim 1 further comprising a beam absorber made of copper of more than 99.99% purity and disposed inside a straight section beam duct at a position upon which the synchrotron radiation is irradiated.

9. A synchrotron radiation source according to claim 1 wherein said beam absorbers are attached with cooling means so as not to be heated by the irradiation of the synchrotron radiation.

10. A synchrotron radiation source comprising:
a bending section/vacuum chamber having one end which a charged particle beam enters and the other end which the charged particle beam leaves;
a bending electromagnet so disposed as to encompass said bending section/vacuum chamber; and
beam absorbers made of a material having a low photodesorption yield and disposed inside said bending section/vacuum chamber at at least positions upon which the synchrotron radiation is irradiated, wherein said beam absorbers made of said low photodesorption yield material are disposed at a portion, irradiated with the synchrotron radiation, of a support adapted to support said bending electromagnet.

11. A synchrotron radiation source comprising:
a bending section/vacuum chamber having one end which a charged particle beam enters and the other end which the charged particle beam leaves;
a bending electromagnet so disposed as to encompass said bending section/vacuum chamber; and
beam absorbers made of a material having a low photodesorption yield and disposed inside said bending section/vacuum chamber at at least positions upon which the synchrotron radiation is irradiated; and
supporting means disposed at least partially in said bending section/vacuum chamber for supporting said bending electromagnet, said beam absorbers being provided inside said bending section/vacuum chamber at those portions thereof, and on those parts of said supporting means, which are directly irradiated by synchrotron radiation generated from the charged particle beam and being made of a vacuum degassed and low photodesorption yield material of more than 99.99% purity.

* * * * *